US005558981A

United States Patent [19]

Bayley

[11] Patent Number: 5,558,981

[45] Date of Patent: Sep. 24, 1996

[54] EMULSIONS WITH THE HIGHEST SPEEDS COMPATIBLE WITH LOW GRANULARITY

[75] Inventor: Robert B. Bayley, Hilton, N.Y.

[73] Assignee: Eastman Kodak Company, Rochester, N.Y.

[21] Appl. No.: 442,238

[22] Filed: May 15, 1995

[51] Int. Cl.[6] ..... G03C 1/035; G03C 1/09

[52] U.S. Cl. ..... 430/567; 430/604; 430/605

[58] Field of Search ..... 430/567, 604, 430/605

[56] References Cited

U.S. PATENT DOCUMENTS

| | | | |
|---|---|---|---|
| 5,051,344 | 9/1991 | Kuno | 430/567 |
| 5,474,888 | 12/1995 | Bell | 430/567 |
| 5,480,771 | 1/1996 | Bell | 430/567 |

OTHER PUBLICATIONS

*Research Disclosure*, vol. 365, Sep. 1994, Item 36544, Section I.

*Primary Examiner*—Janet C. Baxter
*Attorney, Agent, or Firm*—Carl O. Thomas

[57] ABSTRACT

A radiation-sensitive emulsion is disclosed capable of producing the highest attainable speed compatible with low granularity. The silver halide grains (a) have a mean equivalent circular diameter of less than 0.6 μm; (b) have a face centered cubic crystal lattice structure of the rock salt type; (c) have six {100} faces; (d) contain from 95 to 99.5 mole percent bromide ions and from 0.5 to 5 mole percent iodide ions, based on silver; (e) contain in the face centered cubic crystal lattice structure from $5\times10^{-8}$ to $1\times10^{-6}$ mole per silver mole of an iridium dopant comprised of $Ir^{+3}$ ions forming coordination bonds with at least five halide ions occupying adjacent crystal lattice positions; and (f) contain in the face centered cubic crystal lattice structure from $1\times10^{-5}$ to $3\times10^{-4}$ mole per silver mole of a speed enhancing dopant comprised of divalent Group 8 metal ion chosen from among $Fe^{+2}$, $Ru^{+2}$ and $Os^{+2}$ and at least one coordination ligand more electron withdrawing than fluoride ion; (g) the speed enhancing dopant is located in at least a portion of an internal region of the grains formed after 70 percent and before 90 percent of total grain silver has been precipitated and (h) the iridium dopant is located in at least a portion of a central region of the grains and is separated from the speed enhancing dopant by an interposed region containing at least 10 percent of the total grain silver.

10 Claims, No Drawings

EMULSIONS WITH THE HIGHEST SPEEDS COMPATIBLE WITH LOW GRANULARITY

FIELD OF THE INVENTION

The invention relates to photography. More specifically, the invention relates to silver halide emulsions for use in photographic elements.

DEFINITIONS

The term "cubic" grain when referring to grains having a face centered cubic crystal lattice structure of the rock salt type is employed to indicate a grain having six {100} faces.

The term "ECD" refers to the diameter of a circle having an area equal to the projected area of a silver halide grain.

In referring to silver halide grains and emulsions containing two or more halides, the halides are named in order of ascending concentrations.

The term "dopant" is employed to indicate any occlusion within a silver halide grain crystal lattice structure other than silver and halide ions.

The term "low intensity reciprocity failure" (also referred to as LIRF) is employed herein to indicate a lower speed for exposures of longer duration in comparing emulsion samples receiving the same exposure, but over differing time periods ranging from 1/50th to 0.5 second. When the law of photographic reciprocity is satisfied (i.e., there is no reciprocity failure), the speed of a photographic emulsion remains the same for all equal products of I×ti produced by varied values of I and ti, where I is exposure intensity and ti is exposure time.

All references to the periodic table of elements are based on the format adopted by the American Chemical Society, published in the Feb. 4, 1985, issue of the *Chemical and Engineering News.*

*Research Disclosure* is published by Kenneth Mason Publications, Ltd., Dudley House, 12 North St., Emsworth, Hampshire P010 7DQ, England.

BACKGROUND

In classical silver halide photography a photographic element, commonly referred to as a taking film, containing at least one silver halide emulsion layer coated on a transparent film support is imagewise exposed to light, producing a latent image within the emulsion layer. The film is then photographically processed to transform the latent image into a silver or dye image that is a negative image of the subject photographed. The resulting processed photographic element, commonly referred to as a negative, is placed between a uniform exposure light source and a second photographic element, commonly referred to as a photographic paper, containing at least one silver halide emulsion layer coated on a white paper support. Exposure of the emulsion layer of the photographic paper through the negative produces a latent image in the photographic paper that is a positive image of the subject originally photographed. Photographic processing of the photographic paper produces a positive of the subject image. The image bearing photographic paper is commonly referred to as a print.

While both negatives and prints rely on radiation-sensitive silver halide emulsions for image capture, the choices of emulsions for these separate applications are quite different. Silver halide emulsions used in photographic paper to produce prints are usually subjected to high intensity, short duration exposures from a controlled light source. The silver halide emulsions chosen for prints typically contain high (>50M % and, more typically, >90M %) proportions of silver chloride and low (<5M % and, more typically, <1M %) silver iodide to facilitate rapid processing. As compared to the silver halide emulsions employed in taking films, the speeds of silver halide emulsions used to form prints are limited. Speed limitations can be tolerated, since the light source for exposure is entirely under control.

The silver halide emulsions employed in taking films are usually chosen to realize under available lighting conditions the highest attainable speeds compatible with image quality (e.g., granularity) requirements. To maximize speed and speed in relation to granularity, taking films almost universally employ silver iodobromide emulsions.

Since the early 1980's the very highest speed taking films have increasingly relied upon tabular grain emulsions. These emulsions provide superior speed-granularity relationships at moderate to high photographic speeds. However, nontabular grain silver iodobromide emulsions have remained the emulsions of choice for most taking films used to meet image quality (e.g., low granularity) requirements dictating mean grain ECD's to 0.6 μm or less.

A wide variety of dopants have been employed to modify the properties of the silver halide emulsions. A summary of silver halide grain dopants is included in *Research Disclosure*, Vol. 365, Sep. 1994, Item 36544, Section I. Emulsion grains and their preparation, D. Grain modifying conditions and adjustments, sub-paragraphs (3), (4) and (5). In looking through dopant selections for silver halide emulsions it is apparent that grain halide content, shape, size and intended modes of exposure and processing all influence dopant selections. Dopant selections are in most instances carefully tailored to serve specific photographic applications.

Kuno U.S. Pat. No. 5,051,344 discloses silver iodobromide emulsions containing 0.1 to 4 mole percent iodide and, as grain dopants, $5\times10^{-9}$ to $1\times10^{-6}$ mole of an iridium compound and $5\times10^{-9}$ to $1\times10^{-6}$ mole of an iron compound per mole of silver. The grains are of a core-shell structure with the core containing a higher iodide content (at least 3 mole percent greater) than the shell. Kuno specifically prefers both the iridium and iron to be present in the shell. The object is to achieve high contrast with high-illuminance short-duration exposure, rapid processing, and better safe-light handling. The latter requirement, better safe-light handling, is a requirement of increased low intensity reciprocity failure. In other words, the emulsions are intended to be responsive to high intensity, short duration exposures, but relatively unresponsive to the low levels of illumination provided by safe-lights. Kuno recognizes that iridium reduces both high and low intensity reciprocity failure. Kuno's purpose in adding iron is to eliminate the effect of iridium in reducing low intensity reciprocity failure.

SUMMARY OF THE INVENTION

In one aspect this invention is directed to a radiation-sensitive emulsion comprised of silver halide grains containing metal dopants wherein the grains (a) have a mean equivalent circular diameter of less than 0.6 μm; (b) have a face centered cubic crystal lattice structure of the rock salt type; (c) have six {100} faces; (d) contain from 95 to 99.5 mole percent bromide ions and from 0.5 to 5 mole percent iodide ions, based on silver; (e) contain in the face centered cubic crystal lattice structure from $5\times10^{-8}$ to $1\times10^{-6}$ mole per silver mole of an iridium dopant comprised of $Ir^{+3}$ ions forming coordination bonds with at least five halide ions occupying adjacent crystal lattice position; and (f) contain in the face centered cubic crystal lattice structure from $5\times10^{-6}$ to $3\times10^{-4}$ mole per silver mole of a speed enhancing dopant comprised of divalent Group 8 metal ion chosen from among $Fe^{+2}$, $Ru^{+2}$ and $Os^{+2}$ and at least one coordination ligand more electron withdrawing than fluoride ion; (g) the speed enhancing dopant is located in at least a portion of an internal region of the grains formed after 70 percent and before 90 percent of total grain silver has been precipitated; and (h) the iridium dopant is located in at least a portion of a central region of the grains and is separated from the speed enhancing dopant by an interposed region containing at least 10 percent of the total grain silver.

The limited ECD's of the emulsions of the invention assure low levels of granularity while grain composition, configuration and dopants combine to make possible the highest compatible imaging speeds. The emulsions are particularly characterized in that high speeds are realized while also reducing or eliminating entirely low intensity reciprocity failure. Thus, the emulsions of the invention are particularly suited for incorporation in taking films that must convert imagewise exposures of less than high intensity (e.g., ambient or augmented ambient illumination) into images of high quality definition. The emulsions can be employed in black-and-white (silver image) taking films, such as common camera films, reduced format (micro) films and intensifying screen exposed radiographic films. The emulsions are useful in emulsion layer units that contain both the emulsions of the invention and faster emulsion layers, such as tabular grain emulsion layers. It is specifically contemplated to employ the emulsions of the invention as the slower emulsion component(s) of multi-emulsion layer units, such as those of extended exposure latitude films and color negative films.

DESCRIPTION OF PREFERRED EMBODIMENTS

The emulsions of the invention can be realized by doping during their precipitation emulsions silver halide grains which (a) have a mean ECD of less than 0.6 μm;

(b) have a face centered cubic crystal lattice structure of the rock salt type;

(c) have six {100} faces; and (d) contain from 95 to 99.5 mole percent bromide ions and from 0.5 to 5 mole percent iodide ions, based on silver.

The purpose in restricting the mean ECD of the grains as stated in (a) to less than 0.6 μm is to limit the granularity of the emulsions. The purpose of requiring the bromide and iodide content as stated in (d) is to insure the highest attainable photographic speeds compatible with the restricted maximum ECD of (a). All silver halide grains satisfying composition requirements (d) have a face centered cubic crystal lattice structure of the rock salt type in satisfaction of (b). The purpose of (c) in further restricting the grains to those having six {100} faces (i.e., cubic grains) is that in the grain sizes permitted by (a) cubic grains provide higher speeds when optimally sensitized than grains bounded by exclusively by {111} faces, such as octahedral grains and tabular grains with {111} major faces. In other words, before dopant selection to improve further photographic properties, discussed below, emulsion grain characteristics have already been selected to achieve the highest levels of speed compatible with the desired low levels of image granularity made possible by limiting grain size.

Mean grain ECD can take any convenient value less than 0.6 μm. At lower mean ECD's granularity and speed are proportionately lowered. A minimum mean grain ECD of 0.1 μm is contemplated, since few photographic applications are capable of benefiting by smaller grain sizes. A range of grain sizes that provides a preferred balance of photographic speed and granularity occurs when mean ECD ranges from about 0.2 to 0.4 μm.

Silver bromide, which constitutes at least 95 percent of the grain structure, based on silver, forms a face centered cubic crystal lattice structure of the rock salt type. The limited displacement of bromide ions with iodide ions in the crystal lattice structure places strains in the crystal lattice structure required to accommodate the larger iodide ions and is well recognized to enhance photographic speed. Low levels of iodide, preferably at least 0.5 mole percent, are well recognized to increase photographic speed. Generally speed enhancements are fully realized with as little as 1 mole percent iodide, based on silver forming the grains. Higher levels of iodide can be employed for other effects, such as enhanced native blue sensitivity and interimage effects in color photographic elements. However, higher iodide concentrations slow development and therefore unnecessarily high levels of iodide incorporation are usually avoided. For most photographic applications iodide levels of up to 5 mole percent, preferably up to 4 mole percent, based on silver are contemplated. For radiographic imaging applications customary rapid (<90 second) processing requirements dictate still lower maximum iodide concentrations of less than 3 mole percent and, optimally, 1 mole percent or less. Chloride ion concentrations compatible with the bromide and iodide concentrations noted are contemplated, but in the preferred form of the invention the grains are silver iodobromide grains.

The emulsions of the invention require no particular placement of iodide within the grains. Iodide is typically uniformly or substantially uniformly distributed within the grains. Increasing iodide concentrations toward the center of the grain are common and can be employed to advantage to increase development rates. Common practices of adjusting silver ion concentrations in the dispersing medium at the conclusion of precipitation can produce small variances in surface iodide concentrations. Further, it is a well known practice to add potassium iodide to an emulsion to enhance spectral sensitizing dye adsorption. All of these conventional practices are compatible with the practice of the invention.

The grains are precipitated as cubic grains. That is, they exhibit six {100} faces. In their simplest form the grains have the appearance of cubes when micrographically inspected. The edges and corners of the cubic grains can and typically do show some rounding attributable to ripening. A common variant is for the grains to be tetradecahedral, having six {100} faces and micrographically identifiable {111} faces. Cubic grains have three mutually perpendicular axes oriented normally intersecting the {100} faces. The grains of the invention preferably and typically have perpendicular axes of equal length, but are not precluded from having axes of unequal length.

As precipitated the grains can be polydisperse or monodisperse. It is generally preferred that the grains be relatively monodisperse, most preferably exhibiting a coefficient of variation (COV) of ECD of less than 30 percent, optimally less than 15 percent. COV is 100 times the quotient of grain size standard deviation (G) divided by mean grain ECD.

An iridium dopant capable of reducing low intensity reciprocity failure and a Group 8 speed enhancing dopant are incorporated in the grains of the emulsions of the invention. To realize both a reduction in low intensity reciprocity failure and a significant speed increase particular selections of both the concentrations and the relative placements of the iridium and Group 8 speed enhancing dopants are required.

The iridium dopant can be located anywhere within the interior of the grains to obtain a reduction in low intensity reciprocity failure. However, the Group 8 speed enhancing dopant is effective only when located within an internal region of the grains. That region has been determined to be the portion of the grain that is formed after 70 percent and before 90 percent of the grain silver has been precipitated. The Group 8 speed enhancing dopant can be distributed uniformly throughout the 20 percent of the silver forming this internal region or can be located in any convenient portion of this region. If the Group 8 speed enhancing dopant is placed at or closer to the surface of the grains, the Group 8 speed enhancing dopant is ineffective. A possible explanation is that the Group 8 speed enhancing dopant is competing with surface chemical sensitization sites on the grains. On the other hand, if the Group 8 speed enhancing dopant is too deeply buried, its contribution to speed increase is also diminished. This is believed to be attributable to the increased diffusion path length that a photoelectron temporarily trapped by the Group 8 speed enhancing dopant must travel before reaching the grain surface and thereby becoming available to participate in latent image formation.

Even if the Group 8 speed enhancing dopant is correctly placed within the crystal lattice structure of the grains, it still is ineffective to increase speed when the iridium dopant is located (1) in the same region of the grain, (2) in an immediately adjacent region, or (3) nearer the surface of the grain than the Group 8 speed enhancing dopant.

It has been discovered quite unexpectedly that both reduced low intensity reciprocity failure and speed enhancement are realized only when the iridium dopant is located within at least a portion of a central region of the grain (i.e., a region of the grain precipitated prior to the internal region of the grain in which the Group 8 speed enhancing dopant is effective) and at least 10 (preferably at least 15) percent of the silver forming the grain separates the central portion containing the iridium dopant from the internal region containing the Group 8 speed enhancing dopant. Stated another way, after introduction of the iridium dopant is completed, at least 10 (preferably at least 15) percent of the total silver forming the grain is precipitated before the Group 8 speed enhancing dopant is introduced.

Specific examples of iridium dopants employed to reduce low intensity reciprocity failure are contained in Kim U.S. Pat. No. 4,449,751 and Johnson U.S. Pat. No. 5,164,292, the disclosures of which are here incorporated by reference. A more general survey of iridium dopants employed to reduce reciprocity failure and for other purposes is provided by B. H. Carroll, "Iridium Sensitization: A Literature Review", *Photographic Scienceand Engineering*, Vol. 24, No. 6, November/December 1980, pp. 265–267. A still more general survey of dopants, including iridium dopants intended to reduce reciprocity failure is provided in Research Disclosure, Item 36544, Section I. Emulsion grains and their preparation, D. Grain modifying conditions and adjustments, sub-paragraphs (3) and (4), cited above.

In a specifically preferred form the iridium dopant is comprised of $Ir^{+3}$ ions forming coordination bonds with at least five halide ions occupying adjacent crystal lattice positions. The iridium dopant can be conveniently incorporated in the form of a hexacoordination complex satisfying the formula:

$$[Ir^{+3}X_5L']^m \quad \text{(I)}$$

where

X is a halide ligand,

L' is any bridging ligand, and m is −2 or −3.

As the iridium is added during precipitation a convenient counter ion, such as ammonium or alkali metal, is associated with the hexacoordination complex, but only the anionic portion of formula I is actually incorporated within the crystal lattice structure. Also, as introduced, the iridium can be in a +4 valence state, as illustrated, for example by Leubner et al U.S. Pat. No. 4,902,611. However, the +4 iridium reverts to the +3 valence state upon incorporation. Chloride and bromide are preferred halide ligands. The bridging ligand L' can also be a halide ligand or, alternatively, can take any convenient conventional form, including any of the various individual ligand forms disclosed in McDugle et al U.S. Pat. Nos. 4,933,272, 4,981,781 and 5,037,732, Marchetti et al U.S. Pat. No. 4,937,180, Keevert et al U.S. Pat. No. 5,037,732 and Olm et al U.S. Pat. No. 5,360,712, the disclosures of which are here incorporated by reference.

Preferred concentrations of the iridium dopant can range up to about $5\times10^{-8}$ to $1\times10^{-6}$ mole per silver mole. Most preferably, the iridium dopant is present in a concentration of from $1\times10^{-7}$ to $5\times10^{-7}$ mole per silver mole.

The speed enhancing dopant is comprised of a divalent Group 8 metal (i.e, $Fe^{+2}$, $Ru^{+2}$ or $Os^{+2}$) and at least one coordination ligand more electron withdrawing than a fluoride ion. The speed enhancing Group 8 dopant can be introduced as a hexacoordination complex satisfying the formula:

$$[ML_6]^n \quad \text{(II)}$$

where

M is a divalent Group 8 cation (i.e, $Fe^{+2}$, $Ru^{+2}$ or $Os^{+2}$),

L represents six coordination complex ligands which can be independently selected, provided that at least four of the ligands are anionic ligands and at least one the ligands is more electronegative than any halide ligand (i.e., more electron withdrawing than a fluoride ion, which is the most electronegative halide ion), and n a is negative integer having an absolute value of less than 5.

At least four of the ligands are required to be anionic to facilitate incorporation of the dopant into the crystal lattice structure of the tabular grains. The remaining two ligands can also be anionic or can take any convenient conventional neutral form, such as carbonyl, aquo or ammine ligands.

Although only one of the ligands is required to be more electronegative than a halide ion, any higher number, up to and including all of the ligands can be more electronegative than a halide ion. One common way of assessing electron withdrawing characteristics is by reference to the spectrochemical series of ligands, derived from the absorption spectra of metal ion complexes in solution, referenced in *Inorganic Chemistry: Principles of Structure and Reactivity*, by James E. Huheey, 1972, Harper and Row, New York and in *Absorption Spectra and Chemical Bonding in Complexes* by C. K. Jorgerisen, 1962, Pergamon Press, London. From these references the following order of ligands in the spectrochemical series is apparent:

$$I^- < Br^- < S^{-2} < SCN^- < Cl^- < NO_3^- < F^- < OH < ox^{-2} < H_2\underline{O} < \underline{N}CS^- < CH_3C\underline{N}^- < \underline{N}H_3 < en < dipy < phen < NO_2^- < phosph \ll CN^- < CO.$$

The abbreviations used are as follows: ox=oxalate, dipy=dipyridine, phen=o-phenathroline, and phosph =4-methyl-2,6,7-trioxa-1-phosphabicyclo[2.2.2]octane. The spectrochemical series places the ligands in sequence in their electron withdrawing properties, the first ($I^-$) ligand in the series is the least electron withdrawing and the last (CO) ligand being the most electron withdrawing. The underlining indicates the site of ligand bonding to the polyvalent metal ion. The efficiency of a ligand in providing the electron withdrawing characteristic needed for speed enhancement increases as the ligand atom bound to the metal changes from Cl to S to O to N to C. Thus, the ligands $\underline{C}N^-$and $\underline{C}O$ are especially preferred. Other preferred ligands are thiocyanate ($\underline{N}CS^-$), selenocyanate ($\underline{N}CSe^-$), cyanate ($\underline{N}CO^-$), tellurocyanate ($\underline{N}CTe^-$) and azide ($N_3^-$).

When the metal M in the hexacoordination complex is $Fe^{+2}$, it is preferred that at least five of the ligands L be more electron withdrawing than a halide ion. When the metal M in the hexacoordination complex is $Os^{+2}$ satisfactory speed enhancement is observed with only one ligand more electron withdrawing than a halide ion, but at least two such ligands are preferred. In a specific, preferred form the hexacoordination complex is comprised of $Os^{+2}$ and six ligands chosen from among halide and cyano ligands with at least one ligand being a cyano ligand. For $Ru^{+2}$ complexes it is preferred that at least three of the ligands be more electronegative than a halide ion. In a specific, preferred form the hexacoordination complex is comprised of $Ru^{+2}$ and six ligands chosen from among halide and cyano ligands with at least three ligands being cyano ligands.

The Group 8 coordination complexes when introduced can be associated with the same charge balancing counter ions as the iridium complexes, described above. Subject to the requirements noted, the ligands L can be selected from the same conventional ligands as L', described above (i.e., from any of the various individual ligand forms disclosed in McDugle et al U.S. Pat. Nos. 4,933,272, 4,981,781 and 5,037,732, Marchetti et al U.S. Pat. No. 4,937,180, Keevert et al U.S. Pat. No. 5,037,732 and Olm et al U.S. Pat. No. 5,360,712, the disclosures of which are here incorporated by reference).

The following are specific illustrations of Group 8 coordination complex dopants capable of enhancing speed when employed in combination with iridium dopants:

| | |
|---|---|
| SED-1 | $[Fe(CN)_6]^{-4}$ |
| SED-2 | $[Ru(CN)_6]^{-4}$ |
| SED-3 | $[Os(CN)_6]^{-4}$ |
| SED-4 | $[Fe(pyrazine)(CN)_5]^{-4}$ |
| SED-5 | $[RuCl(CN)_5]^{-4}$ |
| SED-6 | $[OsBr(CN)_5]^{-4}$ |
| SED-7 | $[FeCO(CN)_5]^{-3}$ |
| SED-8 | $[RuF_2(CN)_4]^{-4}$ |
| SED-9 | $[OsCl_2(CN)_4]^{-4}$ |
| SED-10 | $[Ru(CN)_5(OCN)]^{-4}$ |
| SED-11 | $[Ru(CN)_5(N_3)]^{-4}$ |
| SED-12 | $[Os(CN)_5(SCN)]^{-4}$ |
| SED-13 | $[Fe(CN)_3Cl_3]^{-3}$ |
| SED-14 | $[Ru(CO)_2(CN)_4]^{-1}$ |
| SED-15 | $[Os(CN)Cl_5]^{-4}$ |

Preferred concentrations of the Group 8 speed enhancing dopant can range up to about $5\times10^{-6}$ to $3\times10^{-4}$ mole per silver mole. Most preferably, the Group 8 speed enhancing dopant is present in a concentration of from $1.5\times10^{-5}$ to $2\times10^{-4}$ mole per silver mole.

The emulsions contain a dispersing medium, typically including a hydrophilic colloid peptizer, such as gelatin or a gelatin derivative. Conventional dispersing media for photographic emulsions are summarized in *Research Disclosure*, Item 36544, cited above, Section II. Vehicles, vehicle extenders, vehicle-like addenda and vehicle related addenda. A further summary of conventional photographic emulsion features, photographic element features, exposures and processing is provided in dispersing media for *Research Disclosure*, Item 36544, cited above. In most instances the emulsions are surface sensitized employing chemical sensitizer and spectral sensitizing dyes. *Research Disclosure*, Item 36544, Section IV. Chemical sensitization and Section V. Spectral sensitization and desensitization summarize conventional approaches for effecting chemical and spectral sensitization. In most applications at least one antifoggant or stabilizer is added to the emulsions. Section VII. Antifoggants and stabilizers summarize these types of emulsion addenda.

EXAMPLES

The invention can be better appreciated by consideration in conjunction with the specific embodiments. The notation (C) is employed to designate comparative emulsions while the notation (E) is employed to designate emulsions that are examples of the invention emulsions. Speeds are reported as relative log speeds—e.g., 30 speed units=0.30 log E, where E is exposure in lux-seconds.

Emulsions 1–9

A series of cubic grain silver iodobromide emulsions were prepared. The grains were nearly perfect cubes, were relatively monodisperse, and exhibited a mean ECD of 0.27 μm.

Emulsion Making:

Solutions were prepared as follows:

| | |
|---|---|
| Solution A: | |
| Gelatin | 240 g |
| NaBr | 2 g |
| 1,8-dihydroxy-3,6-dithiaoctane | 1.74 g |
| antifoammant | 0.25 mL |
| Water to make | 6.5 L |
| Solution B: | |
| 3.033 N $AgNO_3$ | |
| Solution C: | |
| 2.954 N NaBr | |
| 0.790 N KI | |
| Solution D: | |
| 2.954 N NaBr | |
| 0.790 N KI | |
| 1.672 g/L $K_4Ru(CN)_6$ | |
| Solution E: | |
| 2.954 N NaBr | |
| 0.790 N KI | |
| 0.837 g/L $K_4Ru(CN)_6$ | |
| Solution F: | |
| 2.954 N NaBr | |
| 0.790 N KI | |
| 0.124 g/L $K_4Ru(CN)_6$ | |
| Solution G: | |
| $8.3\times10^{-5}$ M $K_2IrCl_6$ | |
| Solution H: | |
| Gelatin | 160 g |
| 3,6-dimethyl-4-chlorophenol | 2 g |
| Water to make | 1.0 L |

Emulsion 1(C): Solution A was added to the reaction vessel and brought to pH 3, pAg 8.7 and 68.3° C. Agitation was provided. Solutions B and C were run into the vessel at 94.3 mL/minute, with the flow rate of B finely adjusted to maintain pAg 8.7. After 3 minutes, the pAg was ramped to 8.2 taking 3 minutes and maintained thereafter. After a total of 35 minutes the additions were stopped. The emulsion was cooled to 40° C. and solution H was added. The emulsion was washed until it reached pAg 7.9, concentrated and chill set.

Emulsion 2(C): The emulsion was prepared similarly as Emulsion 1(C), except 60 mL of solution G were added to the vessel from 50–55% of the precipitation (percentage of total silver introduced).

Emulsion 3(C): The emulsion was prepared similarly as Emulsion 1(C), except solution D was substituted for solution C during 75%–90% of the precipitation.

Emulsion 4(E): The emulsion was prepared similarly as Emulsion 1(C), except 60 mL of solution G were added to the vessel during from 50–55% of the precipitation and solution D was substituted for solution C during 75–90% of the precipitation.

Emulsion 5(E): The emulsion was prepared similarly as Emulsion 1(C), except 30 mL of solution G were added to the vessel from 50–55% of the precipitation and solution E was substituted for solution C during 75–90% of the precipitation.

Emulsion 6(C): The emulsion was prepared similarly as Emulsion 1(C), except 60 mL of solution G were added to the vessel during 85–90% of the precipitation.

Emulsion 7(C): The emulsion was prepared similarly as Emulsion 1(C), except solution D was substituted for solution C during 50–65% of the precipitation.

Emulsion 8(C): The emulsion was prepared similarly as Emulsion 1(C), except solution D was substituted for solution C during 50–65% of the precipitation and 60 mL of solution G were added to the vessel from 85–90% of the precipitation.

Emulsion 9(C)): The emulsion was prepared similarly as Emulsion 1(C), except solution E was substituted for solution C during 50–65% of the precipitation and 30 mL of solution G were added to the vessel from 85–90% of the precipitation.

Emulsions 10–12

These emulsions were similar to those above, except that the cubic grain size was reduced 0.25 μm, and the concentrations of the dopants were also reduced.

Emulsion 10(C): This emulsion was prepared similarly to Emulsion 1(C), except the level of 1,8-di- hydroxy-3,6-dithiaoctane in solution A was reduced to 1.4 g.

Emulsion 11(E): This emulsion was prepared similarly to Emulsion 10(C), except 20 mL of solution G were added to the vessel from 50–55% of the precipitation and solution F was substituted for solution C during 75–90% of the precipitation.

Emulsion 12(C): This emulsion was prepared similarly to Emulsion 10(C), except 20 mL of solution G were added to the vessel from 75–90% of the precipitation and solution F was substituted for solution C during 75–90% of the precipitation.

The dopant patterns of the emulsions are summarized in Table I. Dopant concentrations are reported in molar parts per million parts of silver. The location of the dopant is reported in terms of the percentage of total silver precipitated at the beginning and end of dopant addition.

TABLE I

| | Group 8 Dopant | | Iridium Dopant | |
|---|---|---|---|---|
| Emulsion | mppm | Location | mppm | Location |
| 1(C) | 0 | — | 0 | — |
| 2(C) | 0 | — | 0.50 | 50–55% |
| 3(C) | 200 | 75–90% | 0 | — |
| 4(E) | 200 | 75–90% | 0.50 | 50–55% |
| 5(E) | 100 | 75–90% | 0.25 | 50–55% |
| 6(C) | 0 | — | 0.50 | 85–90% |
| 7(C) | 200 | 50–65% | 0 | – |
| 8(C) | 200 | 50–65% | 0.50 | 85–90% |
| 9(C) | 100 | 50–65% | 0.25 | 85–90% |
| 10(C) | 0 | — | 0 | — |
| 11(E) | 15 | 75–90% | 0.17 | 50–55% |
| 12(C) | 15 | 75–90% | 0.17 | 75–90% |

Sensitizations and Evaluations

The emulsion samples were chemically sensitized by melting 1 mole of each emulsion at 40° C. To the melted sample were added 26 mg of 3-methyl-1,3-benzothiazolium iodide, 3 mg of KSeCN, 13 mg of $Na_2S_2O_3.5H_20$, 24 mg $Au_2S$ and 30 mg of 4-hydroxy-6-methyl-1,3,3a, 7-tetraazaindene, sodium salt. Each sample was heated to 71° C., held for 5 minutes and then cooled to 40° C. Each emulsion sample was spectrally sensitized with anhydro-3,3'-bis(2-carboxyethyl)-9-methylthiacarbocyanine hydroxide.

Samples of the emulsions were identically coated on a transparent poly(ethylene terephthalate) transparent film support over an antihalation layer comprising 18.8 mg/dm$^2$ gelatin, surfactant and a solid particle dispersion of absorbing dyes. The emulsion layer as coated contained 14 mg/dm$^2$ Ag, 18.8 mg/dm$^2$ gelatin and a surfactant. The emulsion layer was overcoated with 9.15 mg/dm$^2$ gelatin plus surfactant. The gelatin containing layers were hardened with bis(vinylsulfonyl)methane at 2 percent by weight, based on the total weight of gelatin.

The dried coatings were given 1/50 sec. and ½ sec. exposures to a 2850° K. tungsten light source using a calibrated neutral step tablet (0–3density range) and processed in a Kodak Prostar ™ processor using Kodak Prostar Plus ™ processing solutions. Photographic speeds were measured at a density of 1.0.

The results are summarized in Table II.

TABLE II

| Emulsion | Grp. 8 Location | Ir Location | Log Spd. 1/50"\|1/2" | LIRF |
|---|---|---|---|---|
| 1(C) | — | — | 100\|91 | –9 |
| 2(C) | — | 50–55% | 101\|96 | –5 |
| 3(C) | 75–90% | — | 104\|97 | –9 |
| 4(E) | 75–90% | 50–55% | 108\|103 | –5 |
| 5(E) | 75–90% | 50–55% | 105\|101 | –4 |
| 6(C) | — | 85–90% | 101\|96 | –4 |
| 7(C) | 50–65% | — | 100\|91 | –9 |
| 8(C) | 50–65% | 85–90% | 101\|98 | –3 |
| 9(C) | 50–65% | 85–90% | 100\|97 | –4 |
| 10(C) | — | — | 100\|91 | –9 |
| 11(E) | 75–90% | 50–55% | 107\|104 | –3 |
| 12(C) | 75–90% | 75–90% | 100\|97 | –3 |

Discussion of Results

From Table II it is apparent that undoped control Emulsion 1(C) exhibited a relative log speed of 100 that dropped to 91 when the same exposure was given, but with the time of exposure extended from 1/50" to 1/2". This demonstrated a low intensity reciprocity failure of –9 speed units. All of the controls lacking an iridium dopant exhibited the same –9 LIRF value.

When the iridium dopant was present, LIRF was essentially similar (–3 to –5), whether or not the Group 8 dopant was present. This further demonstrated that the iridium dopant was capable of reducing LIRF at all of the tested levels and locations.

The Group 8 dopant located in the 75–90% silver precipitated grain region was effective to increase speed relative to the remaining control emulsions in every instance, except one. In control Emulsion 12(C) the iridium dopant and the Group 8 dopant were both located in the same region of the grains. No speed enhancement was in this instance observed.

When the Group 8 dopant was shifted to the 50–65% silver precipitated grain region and iridium dopant occupied the 85–90% silver precipitated grain region, no speed increase was observed to result from Group 8 dopant inclusion.

The invention has been described in detail with particular reference to preferred embodiments thereof, but it will be understood that variations and modifications can be effected within the spirit and scope of the invention.

What is claimed is:

1. A radiation-sensitive emulsion comprised of silver halide grains containing metal dopants wherein the grains (a) have a mean equivalent circular diameter of less than 0.6 μm;

(b) have a face centered cubic crystal lattice structure of the rock salt type;

(c) have six {100} faces;

(d) contain from 95 to 99.5 mole percent bromide ions and from 0.5 to 5 mole percent iodide ions, based on silver;

(e) contain in the face centered cubic crystal lattice structure from $5\times10^{-8}$ to $1\times10^{-6}$ mole per silver mole of an iridium dopant comprised of an $Ir^{+3}$ ion forming coordination bonds with at least five halide ions occupying adjacent crystal lattice positions; and (f) contain in the face centered cubic crystal lattice structure from $5\times10^{-6}$ to $3\times10^{-4}$ mole per silver mole of a speed enhancing dopant comprised of a divalent Group 8 metal ion chosen from among $Fe^{+2}$, $Ru^{+2}$ and $Os^{+2}$ and at least one coordination ligand more electron withdrawing than fluoride ion;

(g) the speed enhancing dopant is located in at least a portion of an internal region of the grains formed after 70 percent and before 90 percent of total grain silver has been precipitated; and (h) the iridium dopant is located in at least a portion of a central region of the grains and is separated from the speed enhancing dopant by an interposed region containing at least 10 percent of the total grain silver.

2. An emulsion according to claim 1 wherein the iridium dopant is present in a concentration of from $1\times10^{-7}$ to $5\times10^{-7}$ mole per silver mole.

3. An emulsion according to claim 1 wherein the speed enhancing dopant is present in a concentration of from $1.5\times10^{-5}$ to $2\times10^{-4}$ mole per silver mole.

4. An emulsion according to claim 1 wherein the iridium dopant is separated from the speed enhancing dopant by an interposed region containing at least 15 percent of total grain silver.

5. An emulsion according to claim 1 wherein the silver halide forming the grains is silver iodobromide.

6. An emulsion according to claim 5 wherein the grains have a mean equivalent circular diameter in the range of from 0.2 to 0.4 μm.

7. An emulsion according to claim 1 wherein the grains have a mean equivalent circular diameter of at least 0.1 μm.

8. An emulsion according to claim 1 wherein the speed enhancing dopant is comprised of $Os^{+2}$ and six ligands chosen from among halide and cyano ligands with at least one ligand being a cyano ligand.

9. An emulsion according to claim 1 wherein the speed enhancing dopant is comprised of $Ru^{+2}$ and six ligands chosen from among halide and cyano ligands with at least 3 ligands being cyano ligands.

10. An emulsion according to claim 1 wherein the speed enhancing dopant is comprised of $Fe^{+2}$, $Ru^{+2}$ or $Os^{+2}$ and 6 cyano ligands.

* * * * *